US007213852B2

(12) United States Patent
Zhu

(10) Patent No.: US 7,213,852 B2
(45) Date of Patent: May 8, 2007

(54) LIFTING APPARATUS WITHOUT ELECTRIC CABLE

(75) Inventor: Changbiao Zhu, Shanghai (CN)

(73) Assignee: Shanghai Zhanhua Port Machinery Co., Ltd., Shanghai (CH)

( * ) Notice: Subject to any disclaimer, the term of this patent is extended or adjusted under 35 U.S.C. 154(b) by 0 days.

(21) Appl. No.: 10/733,849

(22) Filed: Dec. 11, 2003

(65) Prior Publication Data

US 2004/0189031 A1 Sep. 30, 2004

Related U.S. Application Data

(63) Continuation of application No. PCT/CN02/00172, filed on Mar. 18, 2002.

(30) Foreign Application Priority Data

Jun. 13, 2001 (CN) ..... 01 1 13425

(51) Int. Cl.
*B66C 1/00* (2006.01)

(52) U.S. Cl. ..... 294/81.1; 294/81.4; 294/81.53; 294/905

(58) Field of Classification Search ..... 294/81.1, 294/81.53, 81.4, 905
See application file for complete search history.

(56) References Cited

U.S. PATENT DOCUMENTS

| | | | | |
|---|---|---|---|---|
| 3,888,536 | A | 6/1975 | Durenec | |
| 4,035,010 | A | 7/1977 | Kawashita et al. | |
| 5,871,249 | A * | 2/1999 | Williams | 294/86.41 |
| 6,354,782 | B1 * | 3/2002 | Barry | 414/392 |

(Continued)

FOREIGN PATENT DOCUMENTS

| | | |
|---|---|---|
| CN | 1155664 | 7/1997 |

(Continued)

OTHER PUBLICATIONS

U.S. Appl. No. 11/342,309, filed Jan. 27, 2006.

(Continued)

*Primary Examiner*—Eileen D. Lillis
*Assistant Examiner*—Esther Onyinyechi Okezie
(74) *Attorney, Agent, or Firm*—Dorsey & Whitney LLP

(57) ABSTRACT

The invention relates to a spreader system without electric cables for lifting goods containers. The spreader system comprises a spreader and two pulley sets. Each pulley of the pulley sets is fitted with a geared ring, and gears are fixed on the headblock of the spreader. A tapered coupling is fixed on a gear shaft and is connected to planetary speeder, which is, in turn, connected to a bi-directional plunger pump. Through a hydraulic circuit, the bi-directional plunger pump is connected to a hydraulic accumulating power station which comprises a hydraulic accumulator, a nitrogen bottle connected to the hydraulic accumulator through a pipeline, an oil tank, an electric generator, a battery, and an oil motor connected to the electric generator and controlled by a magnetic valve. On the spreader, there is a remote control transmitter in order to transmit signals to the remote control receiver in the cab of a container crane. While the crane hoists the spreader, due to friction, the wire rope will rotate the pulley sets, which will finally drive the bi-directional plunger pump and an accumulative power source will form. Thereby, cables for the spreader can be omitted.

5 Claims, 4 Drawing Sheets

U.S. PATENT DOCUMENTS

| | | | | |
|---|---|---|---|---|
| 2003/0168871 | A1* | 9/2003 | Geis | 294/81.21 |
| 2004/0032140 | A1* | 2/2004 | Solstad | 294/82.15 |

FOREIGN PATENT DOCUMENTS

| | | | |
|---|---|---|---|
| CN | 2373421 | | 4/2000 |
| JP | 10-324493 | | 12/1998 |
| JP | 2001240372 | A | 9/2001 |
| WO | 98/34127 | | 8/1998 |
| WO | 01/58797 | A1 | 8/2001 |
| WO | 01/98195 | A1 | 12/2001 |
| WO | 2005/009885 | A1 | 2/2005 |

OTHER PUBLICATIONS

U.S. Appl. No. 11/360,463, filed Feb. 23, 2006
U.S. Appl. No. 11/376,624, filed Mar. 15, 2006.
U.S. Appl. No. 11/388,780, filed Mar. 24, 2006.
U.S. Appl. No. 11/388,752, filed Mar. 24, 2006.
U.S. Appl. No. 11/434,549, filed May 15, 2006.
U.S. Appl. No. 11/512,733, filed Aug. 30, 2006.
U.S. Appl. No. 11/454,626, filed Jun. 16, 2006.
U.S. Appl. No. 10/875,154, filed Jun. 23, 2004.

* cited by examiner

LIFTING APPARATUS WITHOUT ELECTRIC CABLE

CROSS-REFERENCE TO RELATED APPLICATIONS

This application is a continuation of International Application No. PCT/CN02/00172, filed on Mar. 18, 2002, which claims priority to Chinese Application No. 01113425.9, filed on Jun. 13, 2001, the contents of both applications are incorporated herein by reference.

TECHNICAL FIELD

The invention relates to a lifting apparatus in goods container transport, and particularly to a spreader system without electric cables in a container crane for lifting goods containers.

BACKGROUND ART

In current container handling equipment, there is always an about 60 meter long electric cable hanging between a crane and a spreader used to supply power and for communication. During the processes of lifting and lowering, the hanging cable should be able to be effectively pulled out from or pulled back in a cable basket or a cable reel. Once the lifting speed exceeds a certain value or a high wind comes, the hanging cable may not be pulled out or back smoothly. Thus the cable may drop out of the cable basket, or may be hooked and even broken, which will influence the performance of the crane and its all weather operation. What is more, a hanging cable is very expensive, if broken, it would be costly to replace it with a new one.

If a cable reel is used to pull out or back a cable, a complicated electronic and mechanic drive system has to be installed on a trolley of the crane, which would result in an increased failure rate and maintenance for the whole machine. Besides, in current spreaders for lifting goods containers, a hydraulic power station, used as a power source of a spreader is normally driven by an electric motor, and all the pulleys of the pulley sets on the headblock of the spreader rotate idly with the rotational energy wasted.

SUMMARY OF THE INVENTION

The object on the invention is to provide a spreader system without electric cables. The spreader obtain energy from the rotation of its pulley sets, so it forms an accumulative power source. The communication between the spreader and the crane is realized by remote control. Therefore, a hanging cable between the spreader and the crane can be omitted.

The technical solution of the invention is as follows:

A spreader system without electric cables comprises a spreader for lifting goods containers, an headblock, and two pulley sets installed on the headblock respectively. Each pulley of the pulley sets is fitted with a geared ring. Gears are fixed on the headblock. A tapered coupling is fixed on a gear shaft and is connected with a planetary speeder, at the end of which a bi-directional plunger pump is connected through a flange. A hydraulic accumulating power station is connected to the bi-directional plunger pump through a hydraulic circuit. The hydraulic accumulating power station comprises a hydraulic accumulator installed on the spreader, a nitrogen bottle connected to the hydraulic accumulator trough a pipeline, an oil tank, an electric generator, a battery connected to and charged by the electric generator, and an oil motor which is connected to the electric generator and controlled by a magnetic valve. On the spreader, there are a remote control transmitter and a remote control receiver in order to transmit/receive signals to/from a remote control receiver and a remote control transmitter in the cab of a container crane. While the crane hoists or its trolley moves, due to friction, the wire rope will rotate the pulley sets which will, in turn, drive the bi-directional plunger pump through the above mentioned accessories, thereby energy will be delivered from the bi-directional plunger pump to the hydraulic accumulating power station. Thus an accumulative power source will form on the spreader and can be used to drive the spreader by remote control.

BRIEF DESCRIPTION OF THE DRAWINGS

In the following, the present invention is further illustrated in detail with reference to the accompanying drawings, in which.

BEST MODE FOR CARRYING OUT THE INVENTION

Figure 1:
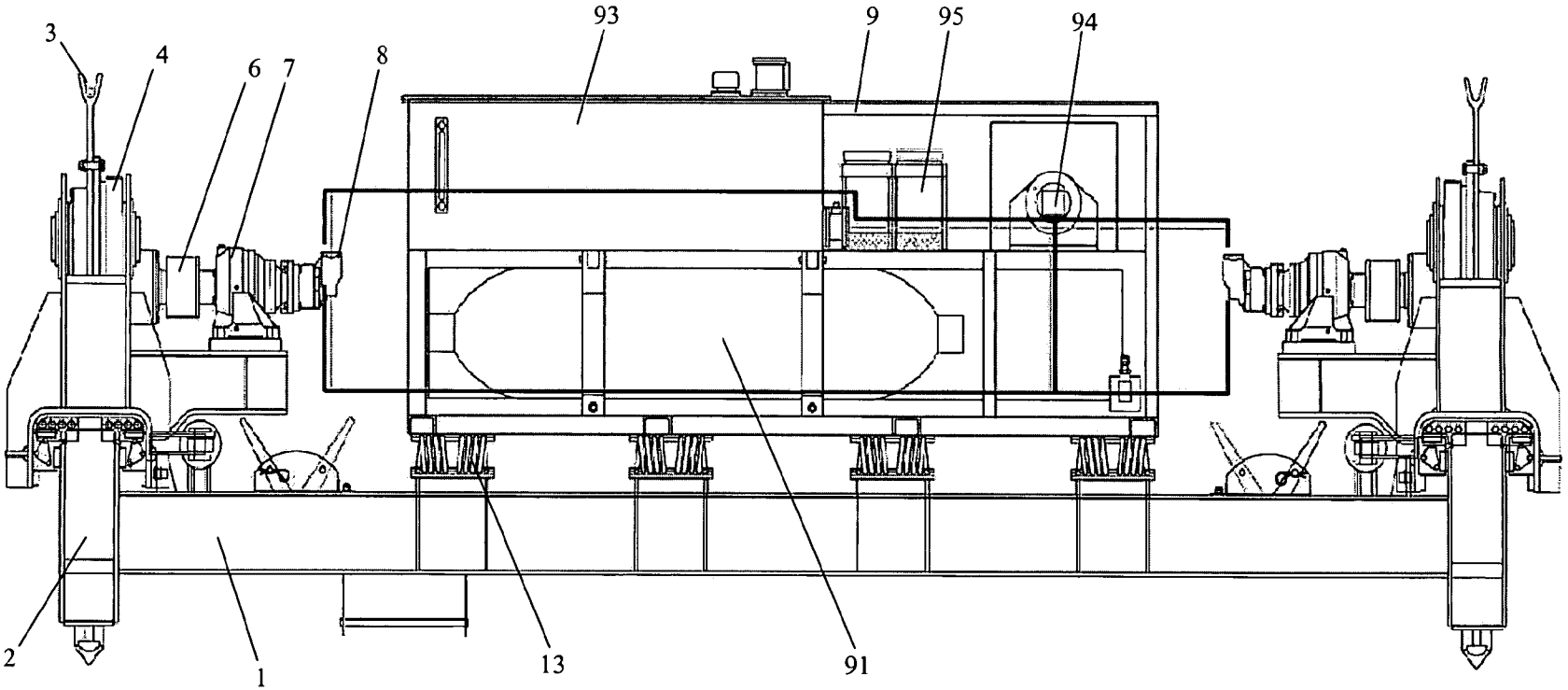
FIG. 1 is a schematic front view of a spreader without electric cables according to an embodiment of the invention.
Figure 2:
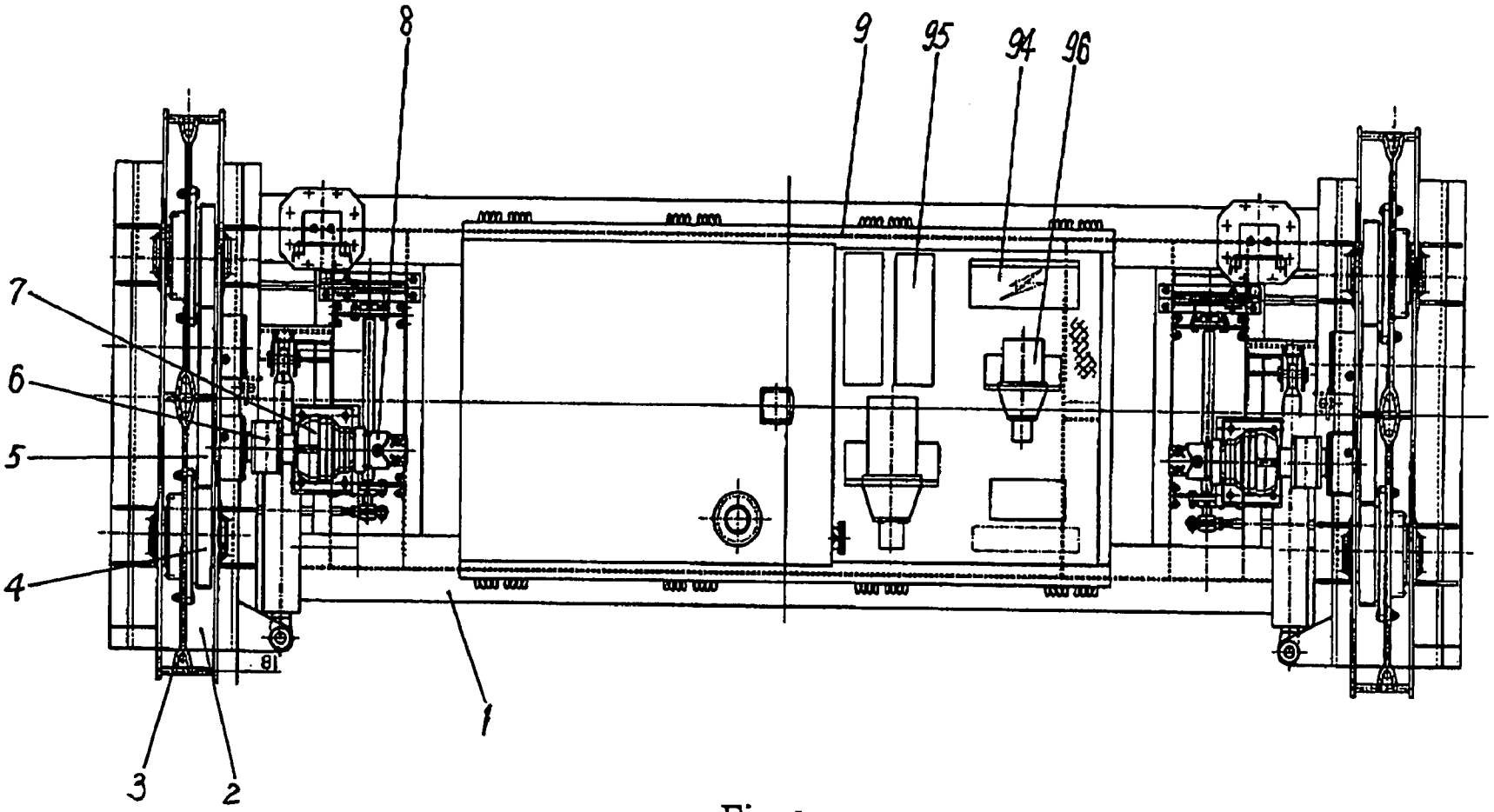
FIG. 2 is a schematic top view of the spreader shown in FIG. 1.
Figure 3:
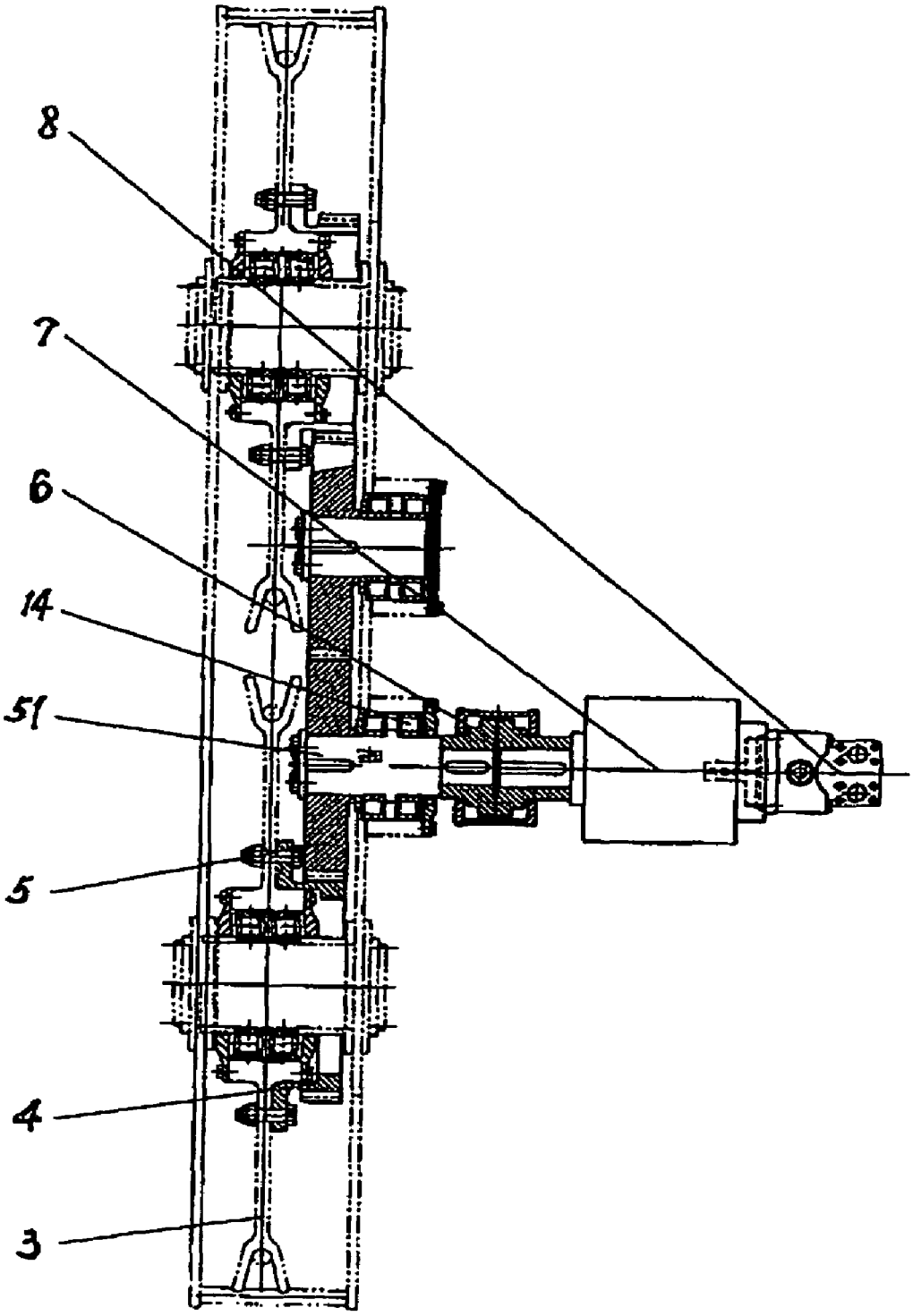
FIG. 3 illustrates schematically the power transmission from the pulley s ts in the spreader shown in FIG. 1 and the connection of relevant mechanism.

Referring to FIGS. 1–4, a spreader system without electric cables of the invention comprises a spreader for lifting goods containers, a headblock 2 and a spreader (not shown). Two pulley sets 3 are installed on the headblock 2 respectively. Each pulley of the pulley sets 3 is fitted with a geared ring 4 by means of a bolt. Gears 5 are fixed on the headblock 2, and a gear shaft 51 is inserted in a bearing 14. To the gear shaft 51 is fixed a tapered coupling 6, which is connected to a planetary speeder 7. At the end of the planetary speeder 7 a bi-directional plunger pump 8 is connected through a flange. A hydraulic accumulating power station 0 is connected to the bi-directional plunger pump 8 through a hydraulic circuit.

The hydraulic accumulating power station 9 comprises a hydraulic accumulator 91 installed on the spreader 1; a nitrogen bottle 92 connected to the hydraulic accumulator 91 through a pipeline; an oil tank 93; an electric generator 94; a battery 95 electrically connected to and charged by the electric generator 94; and an oil motor 96 which is connected to the electric generator 94 and driven by a magnetic valve. The hydraulic accumulating power station 9 is installed on the spreader 1 through several shock-absorbing buffer 13.

When the bi-directional plunger pump rotate either clockwise or counterclockwise, it will output pressurized oil to the hydraulic accumulator to accumulate energy therein for rig the spreader. The hydraulic accumulator could by in ballonet type or piston type. A ballonet or cylinder therein is filled with nitrogen. When the pressurized oil is pressed into the hydraulic accumulator, the nitrogen in the ballonet will be compressed, or the piston will be pushed to compress the nitrogen in the cylinder. The higher the oil pressure is, the smaller the ballonet will become, and more oil can be accumulated. When the hydraulic system of the spreader requires pressurized oil, a magnetic valve will run to deliver oil to it from the hydraulic accumulator. Once enough oil is filled to the hydraulic accumulator by the bi-directional plunger pump, a hydraulic relay will signal the magnetic valve to let it control the oil motor, and the oil motor will, in turn, drive the electric generator to charge the battery.

Figure 4:
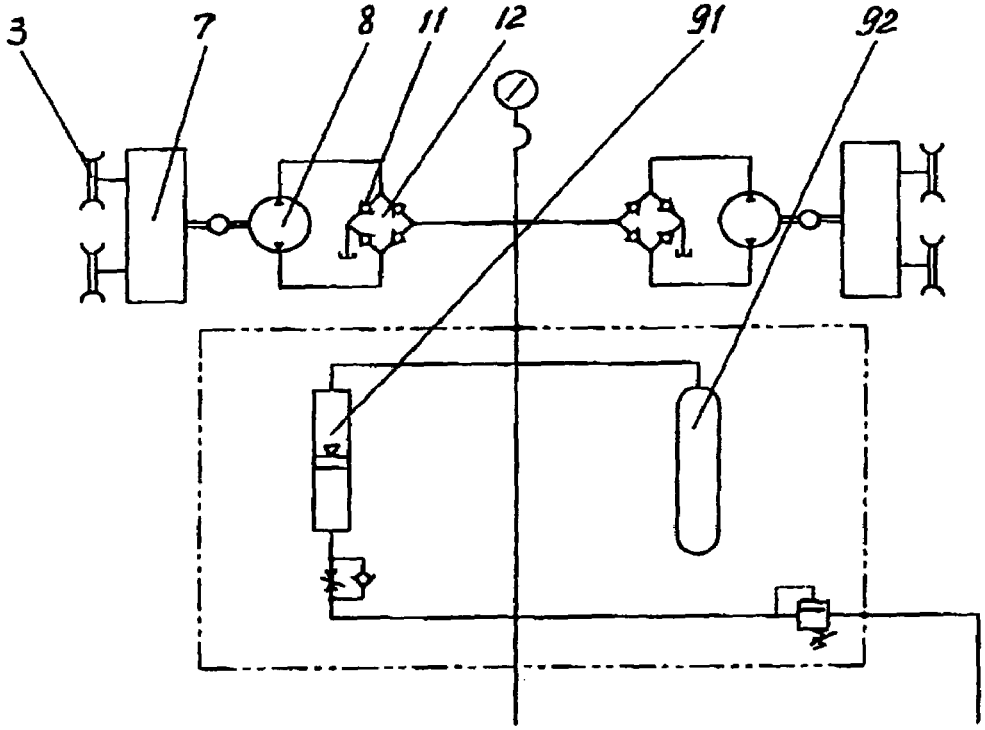
FIG. 4 illustrates schematically the operation of a bi-directional plunger pump in the spreader shown in FIG. 1.

As illustrated in FIG. 4, the pulley sets 3 are, through the FALK-flexible coupling 6 connected to the planetary speeder 7 which is, in turn, connected to the bi-directional plunger pump 8. The bi-directional plunger pump 8 is connected to the hydraulic accumulating power station 9 through a bridge circuit 12 consisting of four check valves 11.

Figure 5:
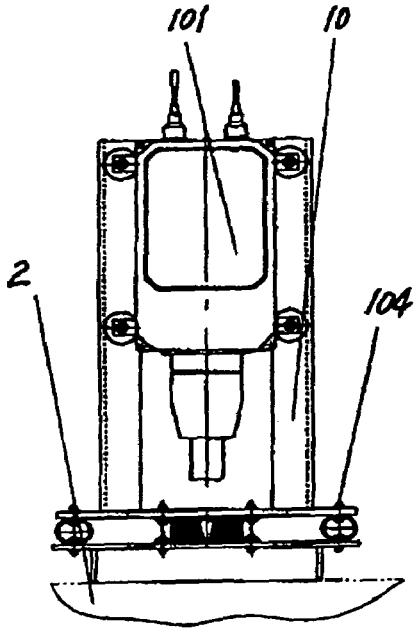
FIG. 5 illustrates schematically the fixation of a remote control transmitter in the spreader shown in FIG. 1.
Figure 6:
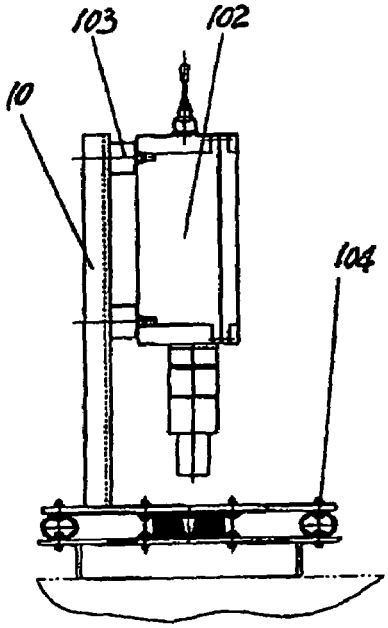
FIG. 6 illustrates schematically the fixation of a remote control receiver in the spreader shown in FIG. 1.

Referring to FIGS. 5 and 6, a remote control transmitter 101 and a remote control receiver 102 are fixed on the bracket 10 and in the cab of a container crane (not shown). Thus the communication between the spreader and the cab can be realized. The signals transmitted include the control and feedback signals for all the spreader actions and the signals of the oil pressure status and voltage status. Therefore, the function, such as automatically making electricity by high pressure in the hydraulic system and automatically raising the alarm at low voltage and low oil pressure, can be realized intelligently.

The configuration of the remote control devices is as follows:

In the cab of the container crane, there is an FSE 716 receiver which receives various position signals from spreader (such as lock and unlock, landing, positions of the 20, 40 feet, etc). The signals will be transmitted to both a PLC intelligent module and some indications on a control board. In the cab, there is also an FSS 716F transmitter, which can send various commands (including lock and unlock, extending and retracting, acting of the flipper, etc.) from the cab to the spreader.

On the headblock of the spreader, there is an FSS716F transmitter the frequency of which is the same as that of the receiver in the cab. All the position signals from the spreader and the headblock are connected to and will be transmitted by the transmitter through radiowave in a fixed frequency band, which will be received by the receiver with the same frequency in the cab and turned into relevant switch signals. The same is true, the receiver on the headblock of the spreader receives the radiowave transmitted by the transmitter in the cab, and turns it into switch signals in order to activate the relevant magnetic valves to run the spreader.

In order to protect the remote control transmitter 101 and remote control receiver 102 from possible damage caused by bucking of the spreader during operation, both of them are equipped with rubber buffers 103 and wire rope buffers 104 to absorb shocks resulted from the running of the spreader.

When the crane hoists the spreader, due to friction, the wire rope will rotate the pulley sets 3 which will, in turn, drive the bi-directional plunger pump 8 through the above mentioned accessories, such as the geared ring 4, the gear 5, the tapered coupling 6, the planetary speeder 7, etc. Thereby energy will be delivered to the hydraulic accumulating power station 9 and therefore, on the spreader an accumulative power source will form and can be used to drive the spreader by remote control.

INDUSTRIAL APPLICATION

In the spreader system without electric cables of the invention, while a crane for lifting goods containers is hoisting or its trolley is moving, the rotational kinetic energy of the pulley sets on the headblock is converted into and accumulated as hydraulic and electric energy to form an accumulative power source on the spreader, which can not only provide power to all the acting parts of the spreader, but can also supply electricity to the remote control units, magnetic valves, indication lamps, limit switches, etc. The invention has, therefore, solved the power problem for the spreader while an electric cable for the spreader is omitted with the communication between the crane and the spreader realized by remote control.

Because of no long cable hanging, such a container crane for goods containers can work in all weather and its hoisting height can be increased Besides, its reliability is well strengthened. Therefore, it can be expected that the invention can widely be used in loading and re-loading in container transport.

What is claimed is:

1. A spreader system without an electric cable, comprising:

a spreader for lifting a container;

a headblock disposed on the spreader; and a plurality of pulley sets disposed on the headblock;

wherein:

each pulley of the pulley sets is coupled with a geared ring;

a plurality of gears are fixed on the headblock;

a tapered coupling is fixed on a gear shaft and is connected to a planetary transmission, the other end of the planetary transmission is connected to a bi-directional piston pump through a flange, the bi-directional piston pump further connected to a hydraulic accumulating power station through a hydraulic circuit, the hydraulic accumulating power station having a hydraulic accumulator, a pipeline, an oil tank, an electric generator, a battery connected to and charged by the electric generator, and an hydraulic motor connected to the electric generator and controlled by a magnetic valve; and on the spreader there is one of a remote control transmitter and a remote control receiver for transmitting or receiving signals to or from one of a remote control receiver and a remote control transmitter in a cab of a container crane;

wherein:

while crane hoists and/or trolley of the container crane move, a wire rope rotates the pulley sets which drives the bi-directional piston pump through the hydraulic accumulating power station, thereby delivering energy from the bi-directional piston pump to the hydraulic accumulating power station and accumulatively forming power on the spreader to drive the spreader by remote control without the electric cable.

2. The spreader system of claim 1, wherein the bi-directional piston pump is connected to the hydraulic accumulating power station by means of a bridge circuit having four check values.

3. The spreader system of claim 1, wherein a plurality of shock-absorbing buffers are disposed proximate to where the hydraulic accumulating power station is fixed on the spreader.

4. The spreader system of claim 1, wherein a plurality of shock-absorbing rubber buffers are fixed on a plurality of trestles for the remote control transmitter or the remote control receiver, respectively.

5. The spreader system of claim 1, wherein a plurality of shock-absorbing wire rope buffers are fixed on a plurality of trestles for the remote control transmitter or the remote control receiver, respectively.

* * * * *